US005613376A

United States Patent [19]

Andó

[11] Patent Number: 5,613,376

[45] Date of Patent: Mar. 25, 1997

[54] THREAD CUTTING AND ASPIRATION UNIT FOR MULTIPLE-FEED CIRCULAR KNITTING MACHINES

[75] Inventor: Jan Andó , Scandicci, Italy

[73] Assignee: Matec S.r.L., Italy

[21] Appl. No.: 582,217

[22] Filed: Jan. 2, 1996

[30] Foreign Application Priority Data

Jan. 25, 1995 [IT] Italy ..... BO95A0018

[51] Int. Cl.[6] ..... D04B 15/61

[52] U.S. Cl. ..... 66/140 S; 66/145 S

[58] Field of Search ..... 66/140 R, 140 S, 66/142, 145 R

[56] References Cited

U.S. PATENT DOCUMENTS

| | | | |
|---|---|---|---|
| 3,066,512 | 12/1962 | Moody | 66/140 S X |
| 3,157,036 | 11/1964 | Coile | 66/145 S |
| 3,222,892 | 12/1965 | Moyer | 66/145 S |
| 3,557,578 | 1/1971 | Fetzer | 66/140 |
| 3,641,790 | 2/1972 | Grewcock et al. | 66/140 |
| 3,714,799 | 2/1973 | Minton | 66/140 S |
| 3,777,513 | 12/1973 | Conti | 66/140 S X |
| 4,130,999 | 12/1978 | Whittaker et al. | 66/140 R X |

FOREIGN PATENT DOCUMENTS

| | | | |
|---|---|---|---|
| 1284283 | 1/1962 | France | 66/140 S |

*Primary Examiner*—John J. Calvert
*Attorney, Agent, or Firm*—Welsh & Katz, Ltd.

[57] ABSTRACT

The thread cutting and aspiration unit has a vertical cutter supporting post which is shifted towards the axis of a toothed thread trimming disk. A cutting blade associated with each cutter is mounted at the end of a lower L-shaped portion of a corresponding supporting post. The L-shaped portion allows thread to pass beyond the cutter and to be cut by a following blade, so that a considerable length of thread can be aspirated by an aspiration port.

3 Claims, 3 Drawing Sheets

THREAD CUTTING AND ASPIRATION UNIT FOR MULTIPLE-FEED CIRCULAR KNITTING MACHINES

BACKGROUND OF THE INVENTION

The present invention relates to a thread cutting and aspiration unit for multiple-feed circular knitting machines for manufacturing socks and stockings.

In conventional circular knitting machines for manufacturing socks or stockings, with a plurality of thread feeds, the thread is cut and retained by respective aspiration ports to prevent the cut piece of thread from escaping from the corresponding thread guide due to the spontaneous recoil of the thread after cutting.

In conventional cutting units, a rotating toothed thread trimming disk moves the thread against a fixed cutter, which is located directly upstream of the aspiration port and cuts the thread that must be aspirated by the respective port: the aspirated portion of thread is very short and often not long enough to ensure a good grip for aspiration, especially in the case of elastic threads or in particular operating conditions.

Accordingly, the thread often escapes from the grip of the aspiration port, with the consequent need to stop the machine for rather long periods.

SUMMARY OF THE INVENTION

A principal aim of the present invention is to obviate the above mentioned drawbacks of conventional devices and to provide a thread cutting and aspiration unit for multiple-feed circular knitting machines that cuts a portion of thread that is long enough to ensure its effective aspiration.

Within the scope of this aim, an object of the present invention is to provide a unit that is simple, relatively easy to execute, safe in use, effective in operation, and has relatively low costs.

This aim and this object are both achieved by the present thread cutting and aspiration unit for a multiple-feed circular knitting machine for manufacturing socks and stockings, characterized in that each vertical cutter supporting post is shifted towards the axis of the toothed thread trimming disk and in that the cutting blade of each cutter is mounted at the end of a lower L-shaped portion of the corresponding supporting post, said L-shaped portion being adapted to allow the thread to pass beyond the cutter and be cut by the following blade, so that the length of thread aspirated by the port is considerably greater.

BRIEF DESCRIPTION OF THE DRAWINGS

Further characteristics and advantages of the invention will become apparent from the following detailed description of a preferred but not exclusive embodiment of a thread cutting and aspiration unit for a multiple-feed circular knitting machine for manufacturing socks and stockings according to the invention, illustrated only by way of non-limitative example in the accompanying drawings, wherein.

DESCRIPTION OF THE PREFERRED EMBODIMENTS

Figure 2:
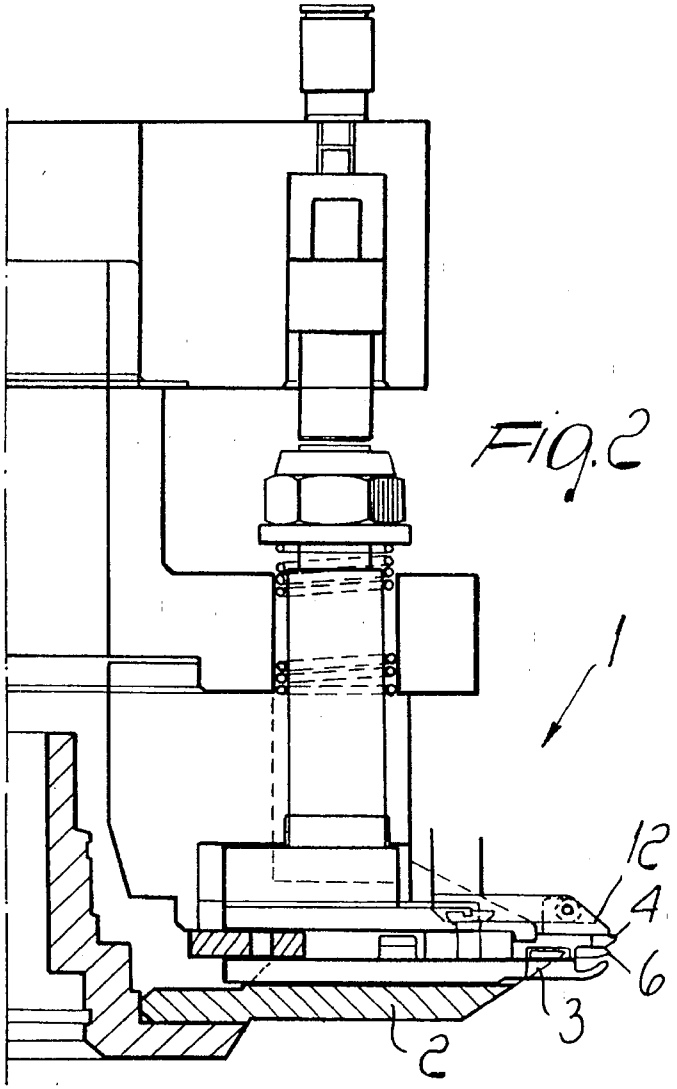
FIGS. 1 and 2 are partially sectional side views, taken along different angles and along vertical planes, of a thread cutting and aspiration unit for a multiple-feed circular knitting machine for manufacturing socks and stockings.
Figure 1:
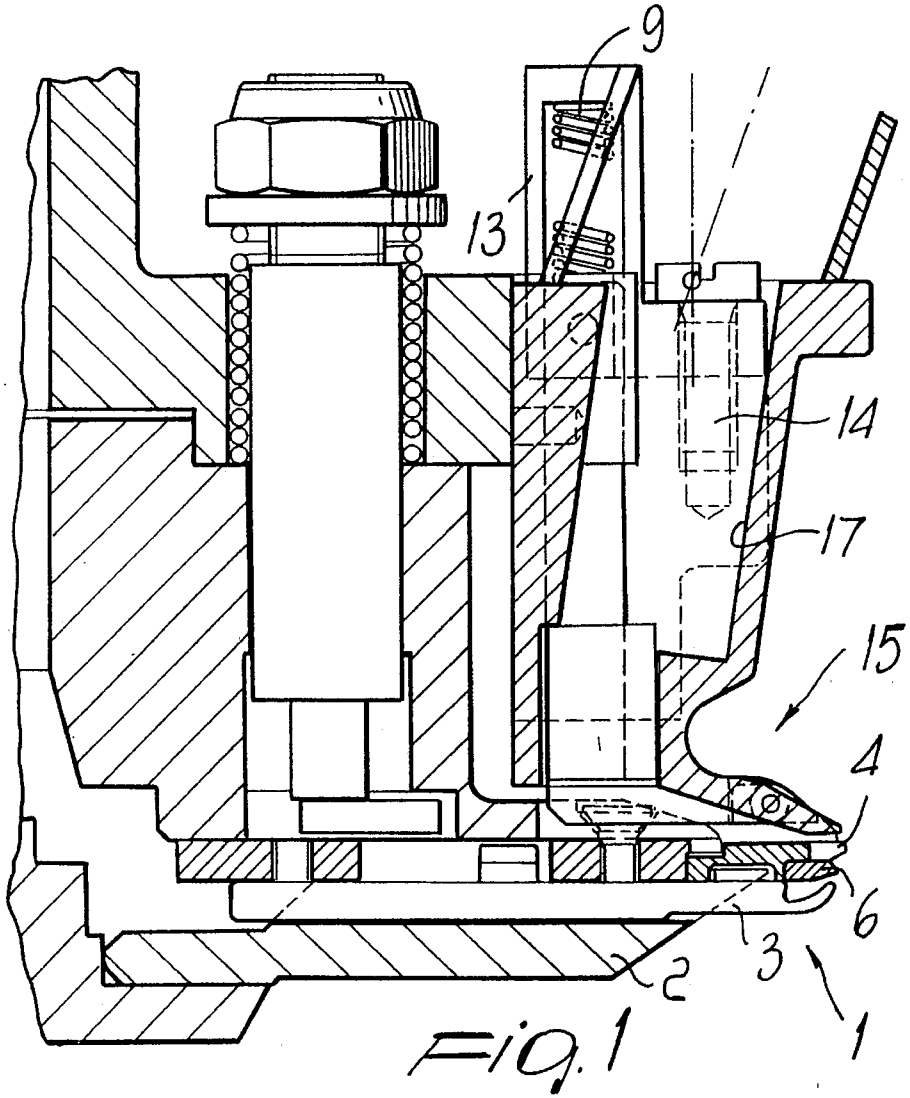

With particular reference to the above figures, the reference numeral 1 generally designates a thread cutting and aspiration unit for a multiple-feed circular knitting machine for manufacturing socks and stockings, according to the invention.

Figure 4:
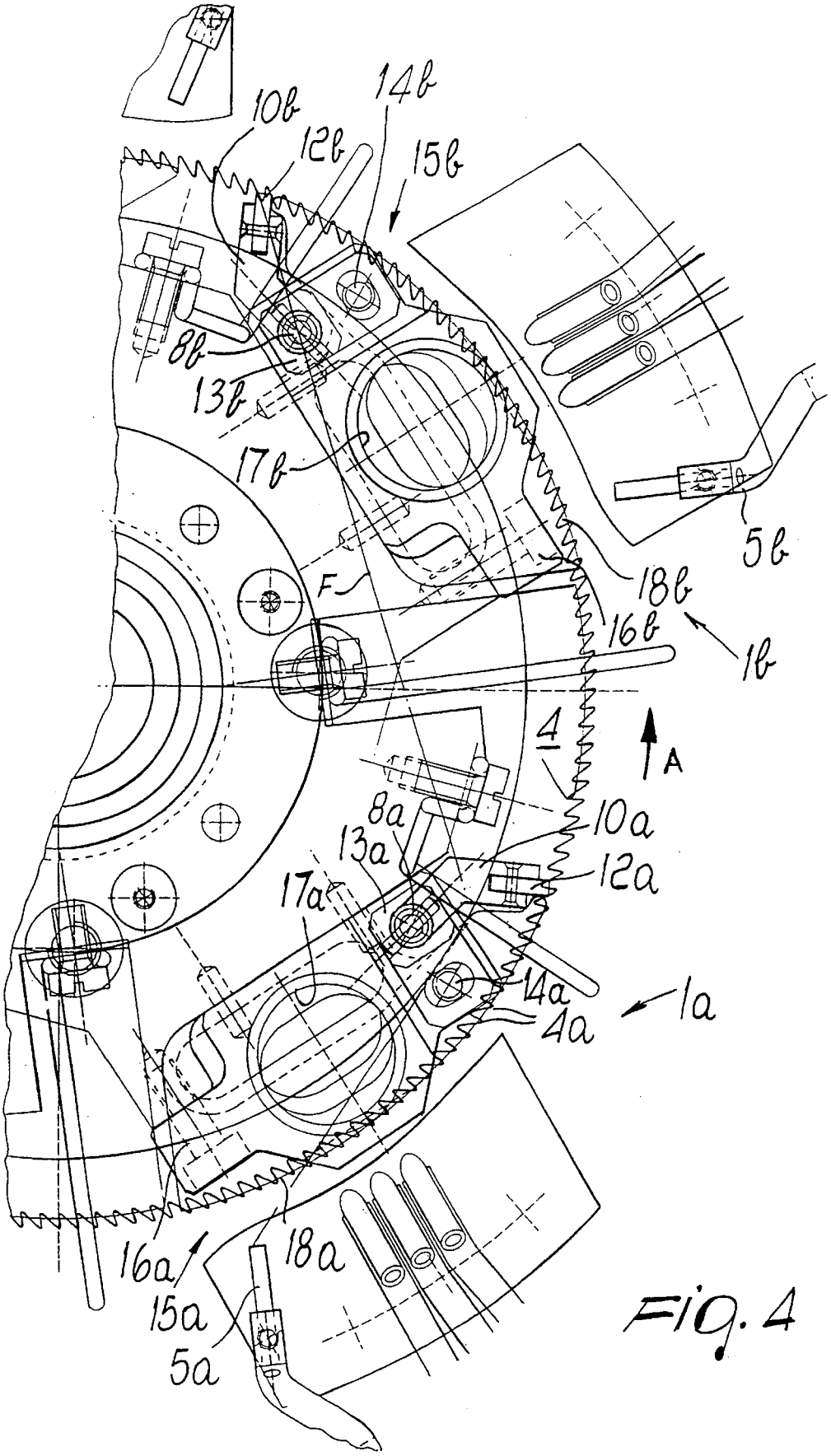
FIG. 4 is a plan view of a sector of the circular knitting machine, equipped with two units according to the invention.
Figure 5:
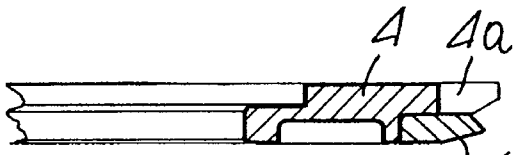
FIG. 5 is an enlarged-scale sectional side view of a detail of the main disk and of the secondary disk of the unit.

The unit 1 comprises a platen 2, provided with a plurality of radial slots for guiding hooks 3, on which a toothed thread trimming disk 4 is supported so that it can rotate in the direction of the arrow A; (FIG. 4) said disk has teeth 4*a* substantially shaped like saw teeth; the reference numerals 5*a* and 5*b*. FIG. 4 designate two successive thread guides, which correspond to the thread feeds of the machine and can be four or more. Two thread cutting and aspiration units 1*a* and 1*b* are shown in FIG. 4, and the letters "*a*" and "*b*" are added after the respective reference numerals indicating identical parts for each unit.

A coaxial secondary disk 6 is mounted beneath the thread trimming disk 4 and has a slightly smaller radius than the disk 4, so that the external portions of the teeth 4*a* protrude beyond the outer periphery of the secondary disk 6.

Figure 6:
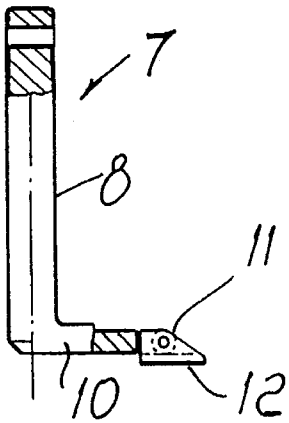
FIG. 6 is a partially sectional lateral plan view of a thread cutter.
Figure 7:
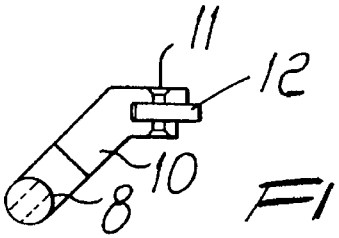
FIG. 7 is a top view of the cutter of FIG. 6.
Figure 3:
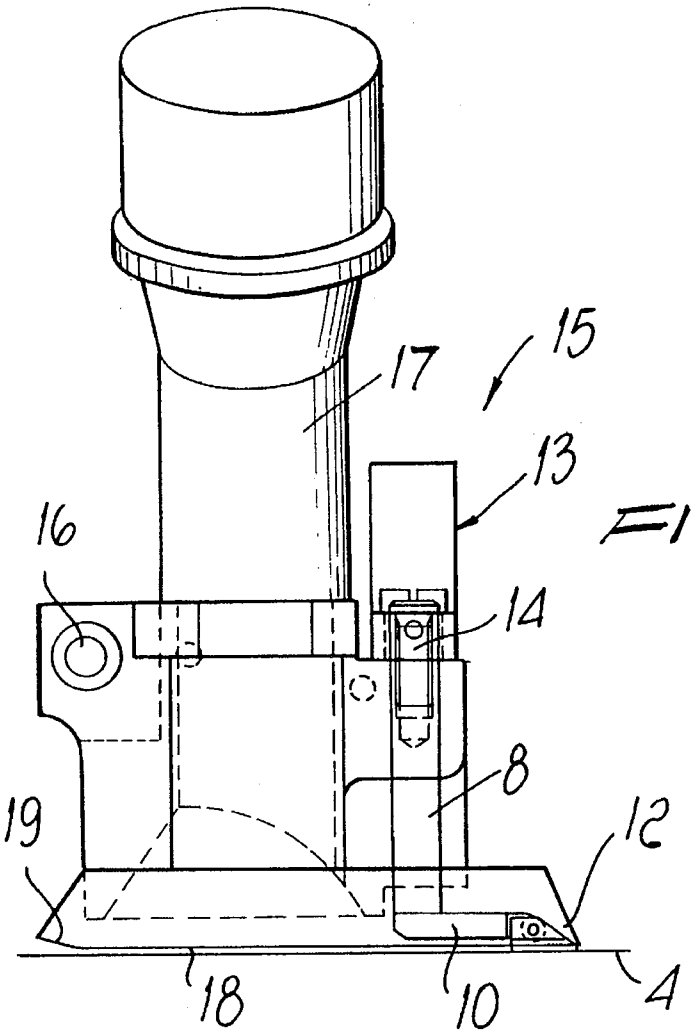
FIG. 3 is a front view of the unit.

A thread cutter 7 (FIG. 6) is provided at each feed and is constituted by a vertical post 8 that is pushed downwardly by an upper compression spring 9 having one end abutting the post 8 and another end abutting the end of a seat 13. The post 8 is provided, in a downward region, with an L-shaped portion 10 that defines, at an end portion thereof, a fork in which an oscillating blade 12 is mounted so that it can oscillate about a horizontal-axis pivot 11 (two successive blades 12*a*, 12*b* are visible in the FIG. 4): the vertical post 8 is guided in the vertical seat 13, and the seat 13 is fixed by means of a screw 14 to an aspiration port 15; with respect to conventional posts, the post according to the invention is shifted towards the axis of the toothed thread trimming disk, and the L-shaped portion 10 allows the thread F to pass beyond the cutter without interfering with the post and being cut, as will become apparent hereinafter, by the following blade, so that the length of thread aspirated by the port is considerably greater.

The radius of the secondary disk 6 is slightly greater than the distance from the rotation axis of the machine of the cutting lines of the blades 12 of the cutters, so that the thread F exiting from a thread guide and picked up by the toothed disk slides against the tapered edge of the secondary disk 6 and remains spaced from the cutting line of the cutter 12*a* that corresponds to the thread guide where the thread exits (for example 5*a*); the rotation of the disk 4 moves the thread, which is picked up by a tooth 4*a*, into a condition for being cut by the blade of the following cutter (for example 12*b*).

The aspiration ports 15, one for each feed of the machine, are fixed by screws 16 to the fixed structure of the machine and are essentially constituted by a tubular duct 17 that is tilted slightly with respect to the vertical and is connected to an aspiration unit, which is proximate to the toothed disk 4 in a downward region.

In a peripheral region, the bases 18 of the aspiration ports have a circular shape, and their distance from the axis of the machine is greater than the cutting lines of the blades 12 of the cutters and slightly smaller than the radius of the toothed disk 4, so that the thread picked up by the disk 4 first slides against the base, for example 18*a*, in a condition in which it is spaced from the cutting line of the corresponding cutter, and then, by tilting with respect to an axis lying at right angles to the surface of the disk for the rotation of the thread trimming disk, enters from behind, through a short rising rear profile 19, beneath the base, for example 18*b*, of the following aspiration port and is engaged by the blade 12*b* of the corresponding following cutter.

The end of the thread F, cut by the blade 12*b*, is aspirated by the previous port 15*a* and is long enough to ensure that the port retains it assuredly (the length of the end of the thread is greater than the length obtainable with conventional devices by an extent corresponding to the distance between two successive cutters).

It is thus evident that the invention achieves the intended aim and object.

The invention thus conceived is susceptible of numerous modifications and variations, all of which are within the scope of the inventive concept.

All the details may furthermore be replaced with other technically equivalent ones.

In practice, the materials employed, as well as the shapes and the dimensions, may be any according to the requirements without thereby abandoning the scope of the protection of the appended claims.

What is claimed is:

1. Thread cutting and aspiration unit for a multiple-feed circular knitting machine for manufacturing socks and stockings, the unit comprising:

a suction port;

a toothed thread trimming disk with an axis;

a vertical cutter supporting post; and a cutting blade mounted on the supporting post;

wherein the vertical cutter supporting post is shifted towards the axis of the toothed thread trimming disk and wherein the cutting blade is mounted at an end of a lower L-shaped portion of the supporting post, said L-shaped portion being arranged to allow a thread to pass beyond the cutting blade and be cut by a following blade, whereby to increase the length of thread aspirated by the suction port.

2. Thread cutting and aspiration unit for a multiple-feed circular knitting machine for manufacturing socks and stockings according to claim 1, wherein a secondary disk is arranged coaxially below the toothed thread trimming disk, said secondary disk having a radius which is slightly smaller than a radius of the trimming disk and which is greater than a distance from a rotation axis of the machine to a cutting line of the cutting blade that lies above the toothed thread trimming disk, whereby to permit a thread to be picked up by the toothed disk and slide against the secondary disk and remain spaced from the cutting line of the cutting blade for allowing the thread to be cut by the following blade.

3. The unit according to claim 1, wherein in a peripheral region, a base of the suction ports has a circular shape and a distance from an axis of the machine that is greater than a cutting line of the cutting blade and slightly smaller than a radius of the toothed thread trimming disk, whereby to permit a thread to be picked up by said toothed disk and first slide against the base of the suction port in a condition in which the thread is spaced from the cutting line of the cutting blade and second tilt with respect to an axis lying at right angles to a surface of the thread trimming disk, said suction port further comprising a rising rear profile beneath said base.

* * * * *